United States Patent [19]

Theiss

[11] Patent Number: 4,811,784

[45] Date of Patent: Mar. 14, 1989

[54] RUNNING TOOL

[75] Inventor: David H. Theiss, Houston, Tex.

[73] Assignee: Cameron Iron Works USA, Inc., Houston, Tex.

[21] Appl. No.: 187,572

[22] Filed: Apr. 28, 1988

[51] Int. Cl.[4] ..... E21B 23/02; E21B 23/04; E21B 33/128

[52] U.S. Cl. ..... 166/208; 166/217; 166/382; 294/86.25

[58] Field of Search ..... 166/208, 217, 382, 82, 166/83, 183, 348, 123, 125; 294/86.25, 86.24; 285/140, 141

[56] References Cited

U.S. PATENT DOCUMENTS

| | | | |
|---|---|---|---|
| 2,698,056 | 12/1954 | Marshall et al. | 166/217 X |
| 2,894,586 | 7/1959 | Schramm et al. | 166/125 |
| 3,350,130 | 10/1967 | Ahlstone et al. | 294/86.25 |
| 3,357,486 | 12/1967 | Brown | 166/0.6 |
| 3,507,329 | 4/1970 | Stone, Jr. | 166/217 X |
| 3,543,847 | 12/1970 | Haeber | 166/208 X |
| 3,871,449 | 3/1975 | Ahlstone | 166/183 |
| 3,897,823 | 8/1975 | Ahlstone | 166/120 |
| 4,043,390 | 8/1977 | Glotin | 166/215 |
| 4,691,780 | 9/1987 | Galle, Jr. et al. | 166/348 |
| 4,719,971 | 1/1988 | Owens | 166/191 |

*Primary Examiner*—Stephen J. Novosad
*Attorney, Agent, or Firm*—Vinson & Elkins

[57] ABSTRACT

A running tool for lowering, landing and setting a well structure, such as a hanger and an annular seal for sealing between the exterior of the hanger and the interior of the well in which the well structure is landed including a mandrel having means for connecting to a running string, a tool body surrounding and carried by said mandrel and having a purality of windows in its lower portion in which latch element are carried, an actuator sleeve surrounding said mandrel and positioned within said tool body and being free to move axially thereof to engage said latching elements to move them into latching engagement with the interior of the well in the landing position, means for releasably limiting the downward movement of said mandrel with respect to said actuating ring, means limiting the downward movement of said actuating ring with respect to said tool body, and means supported on said mandrel and tool body for carrying an annular seal, setting said annular seal in the annulus between the well structure and the interior of the well and latching said annular seal in its set position.

6 Claims, 4 Drawing Sheets

RUNNING TOOL

BACKGROUND

Running tools have been used in the past for lowering well structures into oil and gas wells or for performing certain functions, such as the manipulation of well structures within the well. Running tools of the prior art have been used to lower equipment such as a well casing hanger into a well housing and to be manipulated to set the hanger in the correct position and to actuate portions thereof so that the hanger is locked or latched into the housing.

U.S. Pat. No. 4,719,971 discloses an annular seal and latching mechanism to be lowered, landed and latched into position within a well housing with a wedging ring 42 which is independently moved by weight or pressure after the casing hanger has been landed. There is no showing in this patent of the running tool nor of any connection by which the running tool could be used in setting the seal and latch after the landing of the hanger and further locking the seal and latch assembly in their set positions.

U.S. Pat. Nos. 3,350,130, 3,357,486 and 3,897,823 all disclose types of running tools used in the lowering and landing of hangers and hanger seals into a well housing and setting the seal and latching the seal in set position. Normally, these types of running tools allow for the circulation of fluids subsequent to the landing of the hanger and prior to the setting of the seal to allow for the cementing of the casing within the well.

U.S. Pat. No. 3,871,449 discloses a running tool for running a casing hanger and a packing assembly in the well together with the tool releasably connected to the hanger when it is landed and still retain the packing assembly above its desired sealed position. A spring shifts a torque sleeve and sets the packing assembly after the hanger body is released from the running tool.

U.S. Pat. No. 4,691,780 discloses a subsea wellhead structure including a running tool which carries a casing hanger and its sealing assembly which is set by rotation and downward movement of the running tool after the hanger has landed

SUMMARY

The present invention relates to an improved well running tool having a tubular body with windows in its lower portion in which dogs are carried which connect the body to the well structure being lowered into the well by the running tool, a tubular mandrel, means releasably supporting the body on the mandrel, an actuator ring being threadedly connected to the mandrel and movable within the dogs to wedge them outward into latching engagement with the well structure, and an actuator retainer ring supported by the body to prevent disengagement of the mandrel from the actuator ring, the engagement between the mandrel and the body and actuator ring allowing downward movement of the mandrel and rotation of the mandrel after landing of the well structure and the support of the well structure on the mandrel bypassing the threaded connection between the mandrel and the actuator ring.

An object of the present invention is to provide an improved running tool for lowering and setting a well structure within a well in which the running tool is capable of performing additional functions within the well after the landing and disengagement of the running tool from the well structure.

Another object of the present invention is to provide an improved running tool for lowering and setting a well structure within a well in which the tool provides direct support for the well structure without imposing the load path of the well structure through the threaded connection of the actuator to the mandrel.

A further object is to provide an improved running tool which releases from the well structure being lowered and installed in the well quickly and easily and can be lowered through the landed well structure to perform additional tasks.

Still another object is to provide an improved running tool which can be used to lower and install a well structure within a well and which will perform many tasks in a single trip of the running tool into the well.

BRIEF DESCRIPTION OF THE DRAWINGS

These and other objects of the present invention are hereinafter set forth and explained with reference to the drawings wherein:

FIG. 7 is a partial detail sectional view to illustrate the relationships of the mandrel, the actuator ring and the body of the running tool shown in FIG. 6.

DESCRIPTION OF THE PREFERRED EMBODIMENT

Figure 1:
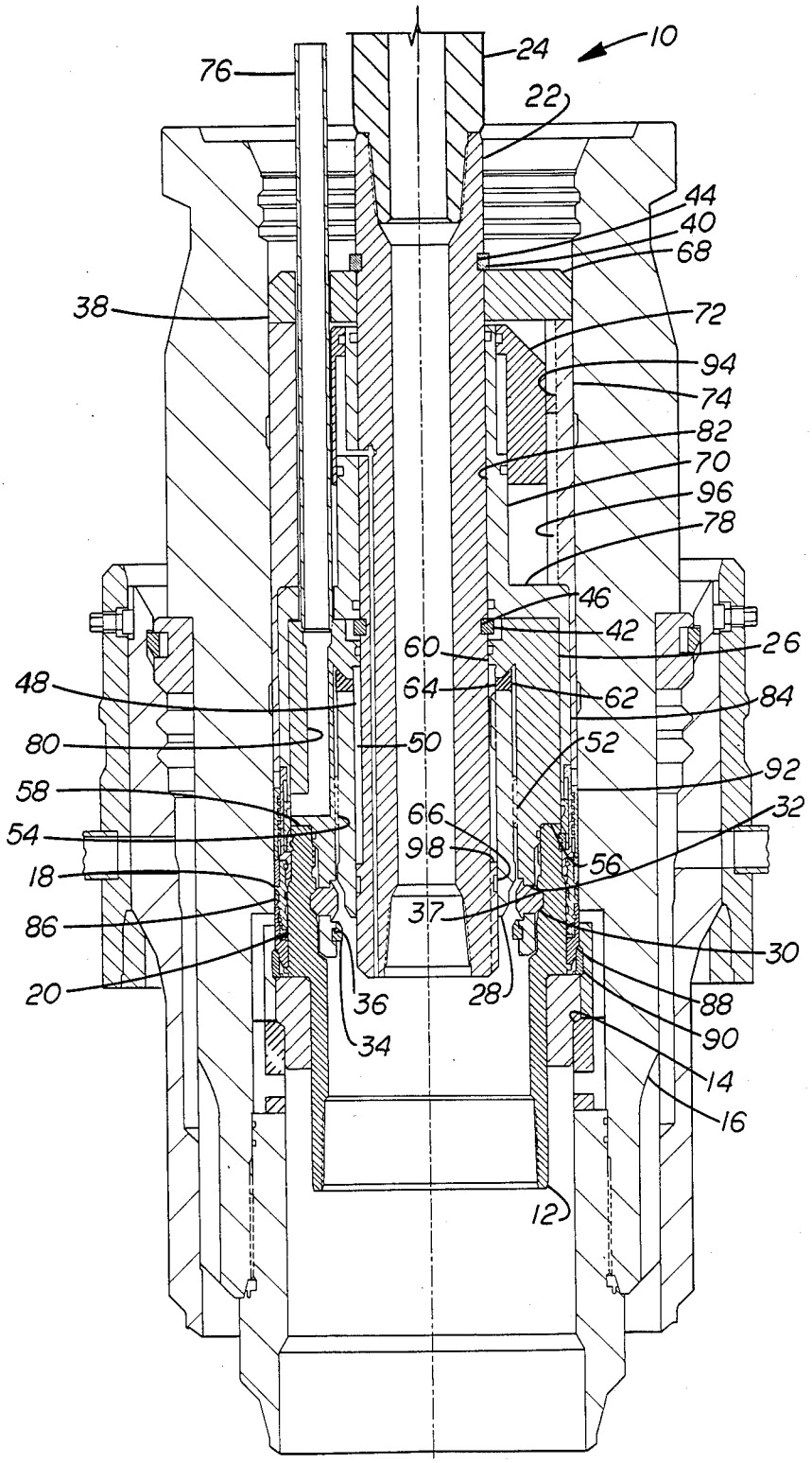
FIG. 1 is a sectional view of the improved running tool of the present invention having a casing hanger landed and latched in position within the well housing and with the seal assembly in set position.

Improved running tool 10 of the present invention is shown in FIG. 1 connected to casing hanger 12 which has been landed on landing seat 14 of well housing 16 with seal assembly 18 set and latched in set position within annulus 20 between the exterior of casing hanger 12 and the interior of well housing 16. Running tool 10 includes tubular mandrel 22 having running string 24 threaded into its upper end as shown, tubular body 26 supported from mandrel 22 with actuator ring 28 positioned between the lower exterior of mandrel 22 and the interior of body 26 to coact with latch elements or dogs 30 which are carried within windows 32 extending through the lower portion of body 26. Retainer ring 34 is positioned in internal groove 36 in the lower interior of body 26 below windows 32 and is a split ring which is biased outwardly into engagement with groove 36. Retainer ring 34 functions to prevent downward movement of actuator ring 28 after it has moved sufficiently to engage latch elements 30 and wedge them outwardly into engagement within internal groove 37 on casing hanger 12 which secures casing hanger 12 to running tool 10. Seal setting and latching tool 38 is supported on the upper exterior of mandrel 22 between upper and lower snap rings 40 and 42 which are retained within their grooves 44 and 46 as shown.

The lower exterior of mandrel 22 includes vertical grooves or splines 48 which are engaged by the internal grooves or splines 50 on actuator ring 28. Left hand threads 52 on the exterior of actuator ring 28 engage within internal left hand threads 54 on the interior of body 26. Body 26 includes external downwardly facing shoulder 56 which engages upwardly facing shoulder 58 on casing hanger 12 when landed. Body 26 also includes inwardly projecting flange 60 which closely surrounds the exterior of mandrel 22 below ring 42 as shown. The lower portion of flange 60 is tapered upwardly and outwardly as surface 62 to receive releasable latching ring 64, which during running engages within groove 66 on the exterior of mandrel but which can be release responsive to rotation of mandrel 22 and actuator ring 28 to thread actuator ring upwardly causing latching ring 64 to be cammed outwardly on surface 62 into the position shown in FIG. 1 wherein it is completely out of engagement with groove 66 on the exterior of mandrel 22. This allows mandrel 22 to be free of actuator ring 28 to allow setting movement of mandrel as hereinafter explained.

Seal setting and latching tool 38 includes upper plate 68 which fits closely around mandrel 22 and within the upper interior of housing 16, inner body 70, annular piston 72, outer latching sleeve 74 and a plurality of tubes 76 which extend through plate 68 and radial portion 78 of body 70 into communication with passages 80 through body 26. Body 70 includes upper tubular portion 82 surrounding the exterior of mandrel 22 and is supported on lower ring 42, radial portion 78 and outer depending seal assembly engaging rim 84. The lower portion of rim 84 is connected to seal assembly 18 as by a J slot connection.

Seal assembly 18 includes seal ring 86 with sealing element thereon as set forth in the copending application Ser. No. 07/159,946, filed Feb. 24, 1988. Lower wedge ring 88 of seal assembly 18 coacts with locking ring 90 when the seal assembly 18 is set to secure casing hanger 12 in position within housing 16. Outer latching sleeve 74 engages the upper edge of latching rim 92 of seal assembly 18 to rotate it after the setting of the seal elements. It should be noted that latching rim 92 is designed so that it interengages with the latching sleeve in the sealing assembly as set forth in the above identified application and functions to latch the seal assembly in its set position after it has been set. Outer latching sleeve 74 is rotated by the downward movement of piston 72 in the space between the interior of sleeve 74 and the exterior of upper portion 82 of body 78. Pin 94 secured to the exterior piston 72 engages within helical slot 96 on the interior of sleeve 74 so that when pressure is supplied into the annular space above piston 72, piston 72 travels downwardly and this downward movement of pin 94 in slot 96 rotates sleeve 74 to move latching rim 92 into position securing the set position of seal assembly 18. Suitable seal and fluid passages are provided to produce the proper operation of piston 72 in a well known manner. It should be noted that tubes 76 which extend through plate 68, piston 72 and radial portion 78 of body 70 ensure that only outer sleeve rotates responsive to the movement of piston 72.

Figure 2:
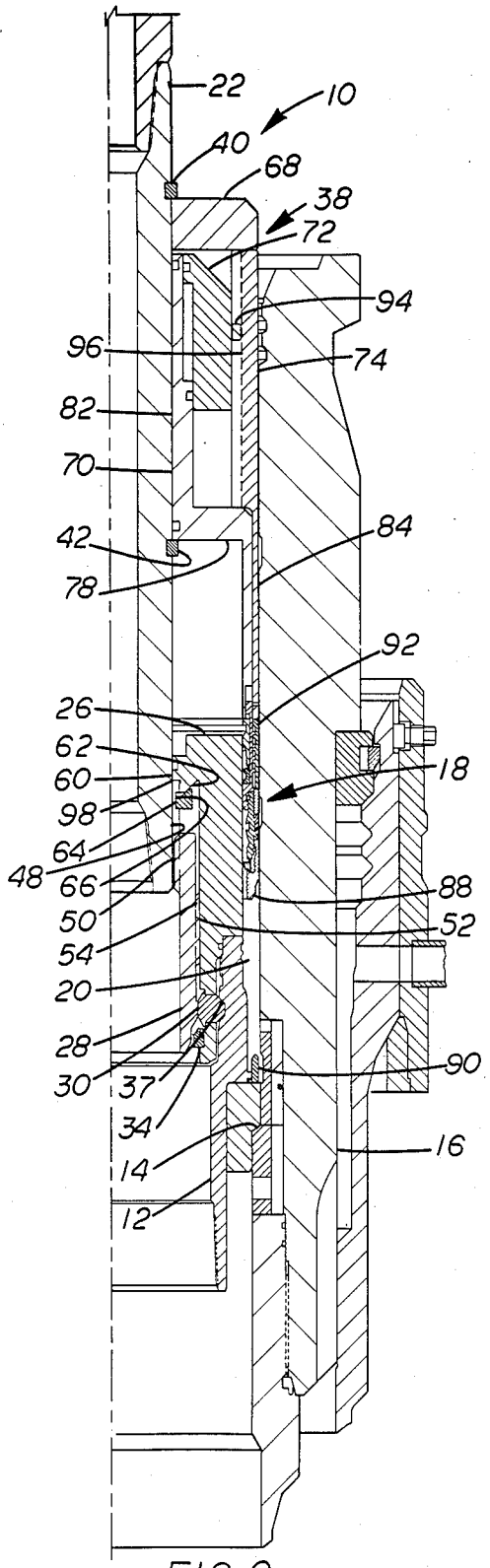
FIG. 2 is a partial sectional view of the improved running tool of the present invention with the casing hanger connected thereto and landed within the well housing.

FIG. 2 illustrate the position of the components with respect to running tool 10 as casing hanger 12 is landed on landing seat 14 of well housing 16. In this position actuator ring 28 is in its lower position wedging latch element 30 into their outer position and in engagement within internal hanger groove 37. Seal assembly 18 is positioned above the passages 80 through body 26 so that circulation can be established for cementing or other operations prior to the setting of seal assembly 18. Seal assembly 18 is supported in this position by the engagement of the lower end of outer rim 84 with the upper portion of seal assembly 18. Also, it should be noted that latching ring 64 which has its upper surface in engagement with tapered surface on flange 60 of body 26 is also in engagement with groove 66 on the exterior of mandrel 22. This position is maintained during the lowering and landing of casing hanger 12 within and onto landing shoulder 14 of well housing 16.

Figure 3:
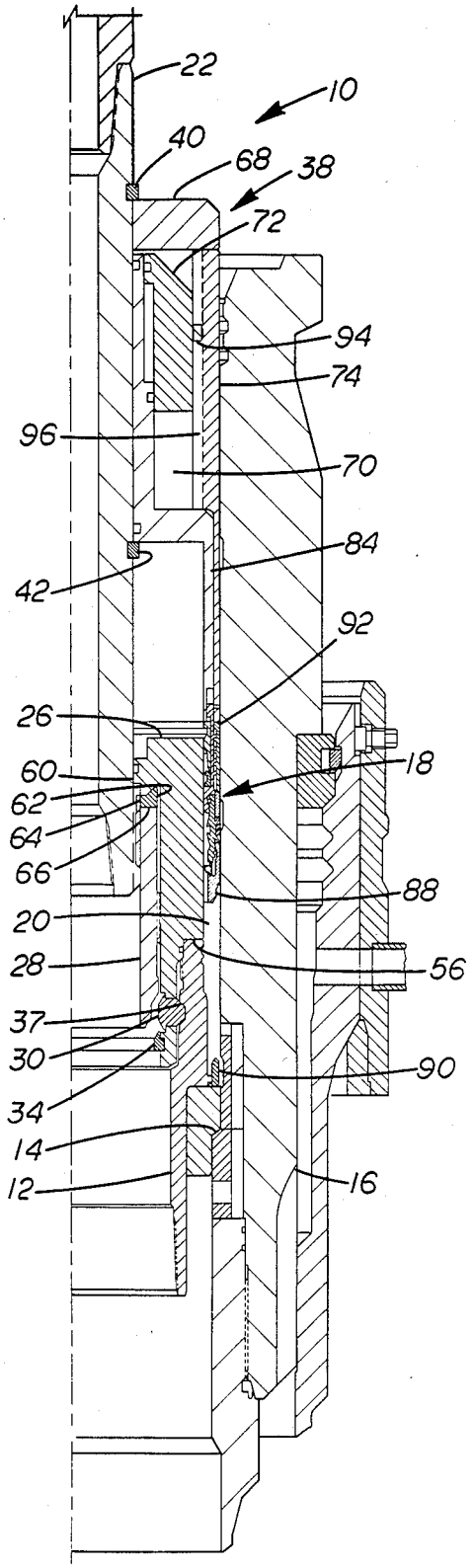
FIG. 3 is a partial sectional view of the improved running tool of the present invention with the casing hanger landed and illustrating the disengaging action which releases the running tool from the actuator ring in preparation to the setting of the seal.

FIG. 3 illustrates the next step in the operations in that seal assembly 18 is still positioned above the opening of passages 80 but mandrel 22 has been rotated to cause actuator ring 28 to be rotated to its upper position. In this position latching ring 64 has been forced against tapered surface 62 on body flange 60 so that it is wedged outwardly out of engagement with groove 66 on mandrel 22. This disengagement frees mandrel 22 for the setting of seal assembly 18.

Figure 4:
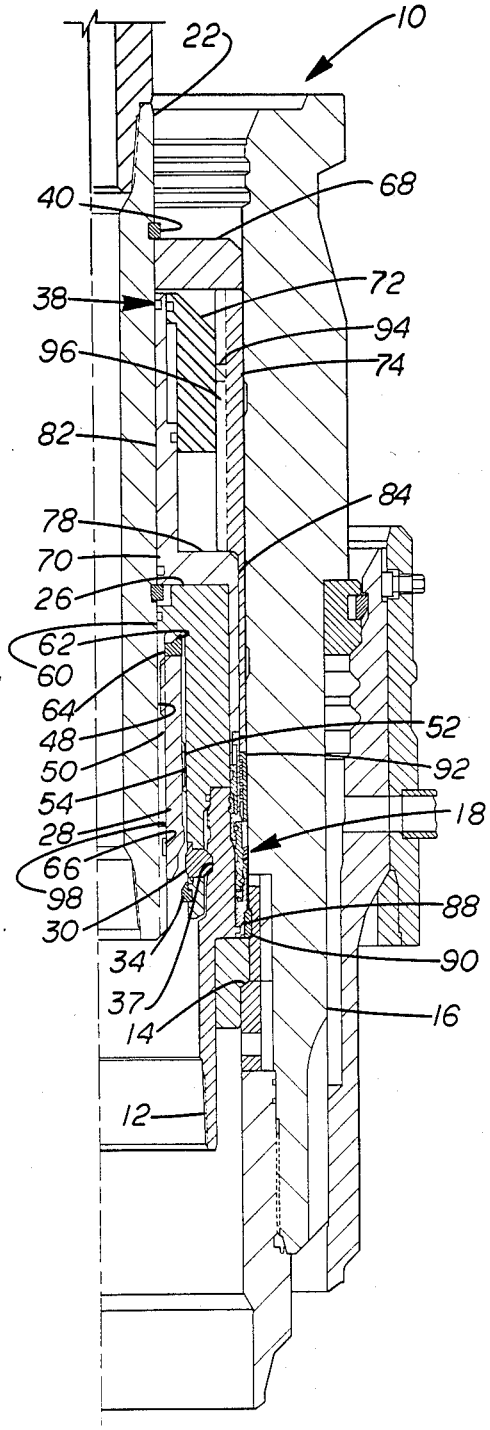
FIG. 4 is a partial sectional view of the improved running tool of the present invention with the running tool disengaged from the actuator ring and lowered to set the seal assembly in the annulus between the casing hanger and the well housing.

As can be seen in FIG. 4 mandrel 22 and seal assembly 18 have been lowered with respect to casing hanger 12 so that seal assembly 18 has moved downwardly in the annulus between the exterior of casing hanger 12 and the interior of well housing 16. In this position lower wedge ring 88 has moved locking ring 90 into its locked position and seal elements are set but not latched in set position.

Figure 5:
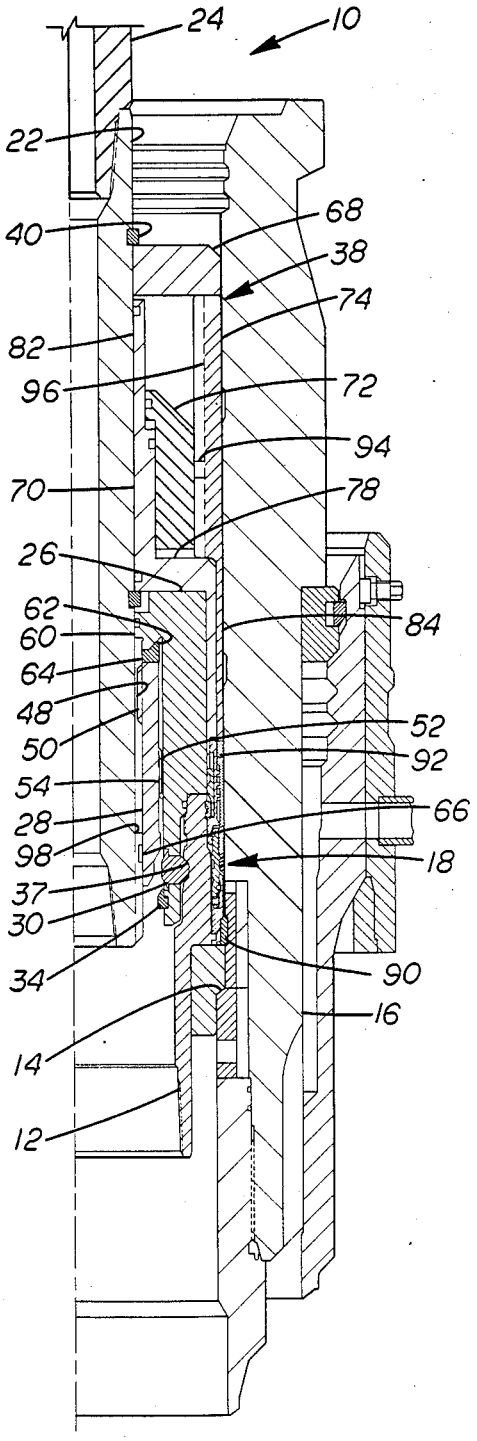
FIG. 5 is another partial sectional view of the running tool to illustrate the setting of the means retaining the seal assembly in its set position.

The latching of seal elements into their set position is illustrated in FIG. 5 wherein piston 72 has been actuated by fluid pressure to its lower position. This movement by virtue of the engagement of piston pin 94 within helical groove 96 on the interior of outer sleeve 74 and the engagement of the lower portion of outer sleeve 74 with the upper end of latching rim 92, latching rim 92 is rotated so that its internal threads engage the external threads of the upper portion of seal assembly 18 to retain it in sealed position as is more fully described in the aforementioned application. With the seal set and latched in set position, running tool may be recovered by merely lifting running string 24. The tapers on latch elements 30 and groove 37 causes latch elements to be cammed inwardly out of groove 37. Further outer rim 84 is disengaged from the upper end of seal assembly 18. As mandrel 22 is raised, shoulder 98 on the exterior of mandrel 22 above groove 66 engages the lower portion of flange 60 to cause the lifting of body 26 and the threaded engagement of body 26 with actuator ring 28 carries actuator ring 28 with the retrieval of running tool 10.

Figure 6:
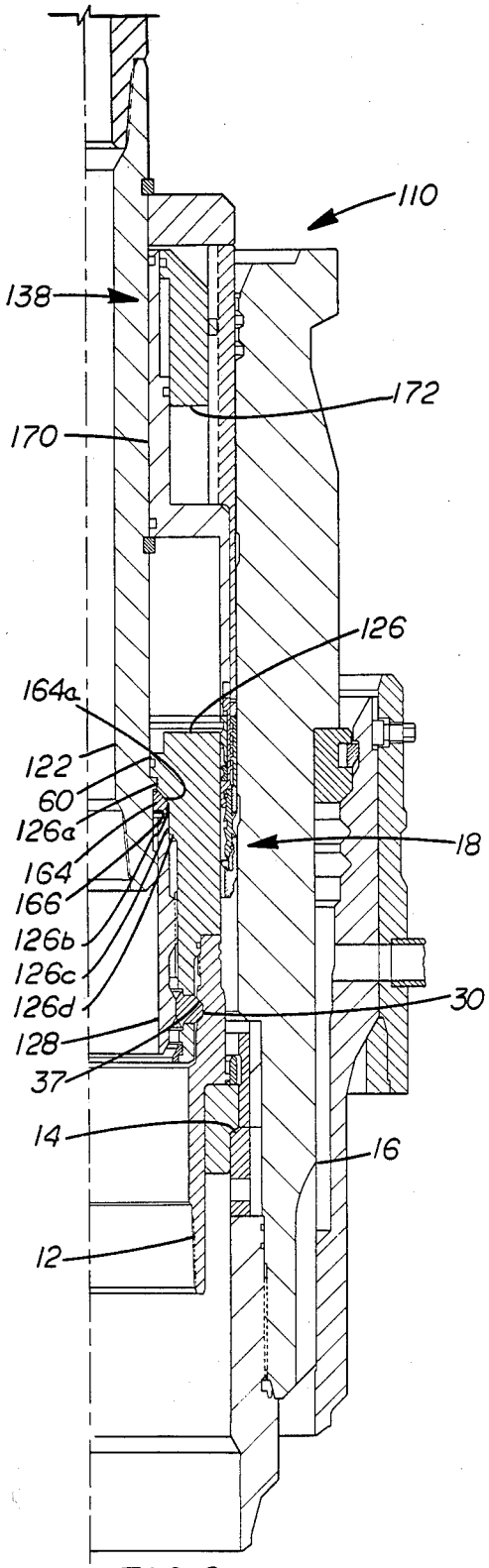
FIG. 6 is a sectional view of a modified form of the improved running tool of the present invention with the casing hanger supported thereon and illustrating the lowering of the casing hanger and seal assembly on the running tool within the well.
Figure 6A:
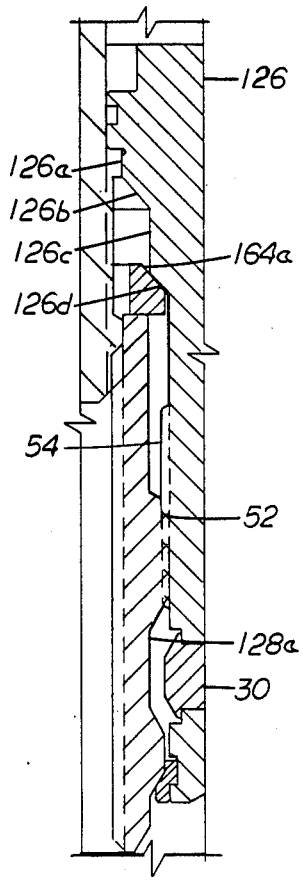

A modified form of running tool 110 is illustrated in FIG. 6 in which the structural change with respect to running tool 10 is in the relationship between the lower end of mandrel 122, actuator ring 128 and body 126. In FIG. 6 all components not changed are given the same numerical designation while the changed components are given the same numerical designation with a "1" prefix. Latching ring 164 is a split ring which is biased radially outward whereas latching ring 64 is a split ring which is biases radially inward. The interior of body 126 below flange 60 includes a short straight surface 126*a* extending downwardly, tapered surface 126*b* extending downwardly and outwardly, straight surface 126*c* extending downwardly and tapered surface 126*d* extending downwardly and outwardly. Latching ring 164 is positioned with its upper outer tapered surface 164*a* in engagement with tapered surface 126*b* on the interior of body 126 during running and actuator ring 128 is in engagement with latching elements or dogs 30 to retain them in engagement with internal groove 37 on the interior of casing hanger 12. Mandrel 12 is released from this position by rotation which causes actuator ring 128 to move downwardly with respect to body 126 so that recess 128*a* on the exterior of actuator ring 128 is opposite latching elements 30 as shown in FIG. 6A. In this position latching ring 164 moves into engagement with tapered surface 126*d* on the interior of body 126.

What is claimed is:

1. A running tool for lowering and manipulating structures within a well comprising a mandrel having means for connecting to a running string at it upper end, a tool body surrounding said mandrel and having radially extending windows through its lower portion, latch dogs carried in the tool body windows, an actuator ring positioned between said body and said mandrel and being movable axially to engage said latch dogs and wedge them outward into latching position, means interconnecting said actuator ring, said tool body and said mandrel for moving said actuator ring to and from its latching position with respect to said latch dogs, means interconnecting said actuator ring and said mandrel for limiting movement of said mandrel downwardly with respect to said actuator, and means on said tool body to release said mandrel movement limiting means to allow said mandrel to move downward within said actuator ring whereby said mandrel may be manipulated in a lowered position to position said well structures carried thereby subsequent to the landing.

2. A running tool according to claim 1 including means for limiting the downward movement of said actuator ring with respect to said tool body.

3. A running tool according to claim 1 wherein said well structure includes a hanger and an annular seal for sealing between the hanger and an interior surface of a well housing within which said well structure is to be landed and including means on said tool for supporting said annular seal separately on said tool from said hanger.

4. A running tool according to claim 3 including a passage through said tool body communicating with the annulus below the annular seal to a position above said tool body.

5. A running tool according to claim 4 including at least one tube extending through said seal supporting means and connecting with said passage through said tool body.

6. A running tool according to claim 4 wherein said seal supporting means includes a pressure responsive member movable axially of said mandrel, a sleeve surrounding said pressure responsive member and engaging a set latching sleeve of said annular seal, and means for converting the axial movement of said pressure responsive member into a rotary movement of the sleeve.

* * * * *